US012698641B2

(12) United States Patent
Cole

(10) Patent No.: US 12,698,641 B2
(45) Date of Patent: Aug. 4, 2026

(54) FASTENING SYSTEM

(71) Applicant: Custom Projects Collective Pty Ltd, Somerville (AU)

(72) Inventor: Greg Cole, Somerville (AU)

(73) Assignee: Custom Projects Collective Pty Ltd, Somerville (AU)

( * ) Notice: Subject to any disclaimer, the term of this patent is extended or adjusted under 35 U.S.C. 154(b) by 342 days.

(21) Appl. No.: 18/206,849

(22) Filed: Jun. 7, 2023

(65) Prior Publication Data

US 2023/0399870 A1 Dec. 14, 2023

(30) Foreign Application Priority Data

Jun. 8, 2022 (AU) ..... 2022901570

(51) Int. Cl.
*E04H 17/12* (2006.01)

(52) U.S. Cl.
CPC ..... *E04H 17/12* (2013.01)

(58) Field of Classification Search
CPC ..... E04H 17/10; E04H 17/12; E04H 17/124; E04H 17/17; A47B 3/006; A63B 2063/005; A63B 3/004; A01K 97/20
USPC ..... 211/85.31, 90.03; 473/446; 405/302.7
See application file for complete search history.

(56) References Cited

U.S. PATENT DOCUMENTS 283,418 A * 8/1883 Ries ..... A47G 25/005 211/35
314,877 A * 3/1885 Rains et al. ..... E04H 17/124 256/48
327,443 A * 9/1885 Jones ..... E04H 17/124 256/57
344,264 A * 6/1886 Gholson ..... E04H 17/055 256/52
469,492 A * 2/1892 Weeks ..... E04H 17/10 256/45
521,849 A * 6/1894 Cretcher et al. ..... E04H 17/12 256/58
544,001 A * 8/1895 McKerns ..... E04H 17/124 256/52
550,392 A * 11/1895 Hayes ..... E04H 17/127 256/52
557,017 A * 3/1896 Phillips ..... E04H 17/131 256/52
626,083 A * 5/1899 Nixon ..... E04H 17/124 256/50
695,954 A * 3/1902 Smith ..... E04H 17/12 256/56
700,383 A * 5/1902 Smith et al. ..... E04H 17/12 256/51

(Continued)

FOREIGN PATENT DOCUMENTS

DE 20307430 U1 * 7/2003 ..... H02G 3/30

*Primary Examiner* — Amber R Anderson
(74) *Attorney, Agent, or Firm* — The Webb Law Firm

(57) ABSTRACT

The present invention relates to a rail that is fixable to a surface and is adapted to provide a support to which flexible materials may be attached. A substantially elongate fastening rail is provided, including a first end and a second end and a plurality of fastening regions having fixing regions located therebetween, wherein the first end, the second end and the fixing regions are each adapted to receive a fixing member. The rail may find particular application in the constructions of netted enclosures.

7 Claims, 3 Drawing Sheets

(56) References Cited

U.S. PATENT DOCUMENTS 731,612 A * 6/1903 Randall ..... E04H 17/124 256/50
735,263 A * 8/1903 Huxley ..... E04H 17/124 256/51
753,913 A * 3/1904 Randall ..... E04H 17/124 256/51
799,813 A * 9/1905 Warneke ..... E04H 17/124 52/297
893,156 A * 7/1908 Fewins ..... E04H 17/124 256/51
947,163 A * 1/1910 Schlared ..... E04H 17/124 256/52
949,206 A * 2/1910 Wise ..... E04H 17/124 256/51
1,394,007 A * 10/1921 Hall ..... A47B 43/04 5/316
1,565,339 A * 12/1925 Thompson ..... E04H 17/12 256/52
2,162,340 A * 6/1939 Peterman ..... F16L 3/04 248/74.5
2,204,559 A * 6/1940 Ahles ..... E01F 15/06 256/13.1
2,951,590 A * 9/1960 Feser ..... A47J 45/00 211/74
3,662,712 A * 5/1972 Singer ..... A01K 1/0272 119/453
4,161,145 A * 7/1979 Patterson, III ..... B65D 90/0053 410/130
4,241,916 A * 12/1980 Palm ..... A63B 63/083 273/400
4,642,934 A * 2/1987 Carlson ..... A01K 63/02 220/495.08
4,709,887 A * 12/1987 Bongiovanni ..... F16L 3/2235 248/66
4,998,627 A * 3/1991 Elder ..... A47F 5/08 211/87.01
5,004,211 A * 4/1991 Rayner ..... E04H 17/10 256/48
6,257,421 B1 * 7/2001 Outten ..... G11B 33/0411 248/303
6,330,948 B1 * 12/2001 Leto ..... A47J 47/20 248/206.3
6,997,329 B2 * 2/2006 Ohanian ..... A47J 47/16 211/181.1
7,364,137 B2 * 4/2008 Neusch ..... E01F 15/06 404/6
7,398,960 B2 * 7/2008 Neusch ..... E01F 15/06 256/48
11,773,548 B2 * 10/2023 Faulkenberry ..... E04H 17/124 256/13.1
11,898,313 B2 * 2/2024 Bowyer ..... E01F 15/06
11,969,659 B2 * 4/2024 Stark ..... A63F 13/98
12,188,588 B2 * 1/2025 Sunderland ..... F16L 3/1218
2004/0060880 A1 * 4/2004 Lang ..... A47K 5/1214 211/85.31
2006/0108742 A1 * 5/2006 Stevens ..... A63B 63/004 473/478
2007/0187347 A1 * 8/2007 McCreary ..... A47J 45/02 211/106
2010/0155353 A1 * 6/2010 McAllister ..... A47B 96/028 211/153
2012/0292273 A1 * 11/2012 Mcnamara ..... A47L 15/503 211/79
2015/0129730 A1 * 5/2015 Gold ..... A47F 5/0815 248/302
2018/0126239 A1 * 5/2018 Goldwitz ..... A63B 63/004
2020/0269106 A1 * 8/2020 Kapsalis ..... A63B 63/004

* cited by examiner

FASTENING SYSTEM

CROSS-REFERENCE TO RELATED APPLICATION

This application claims priority to Australian Patent Application No. 2022901570 filed Jun. 8, 2022, the disclosure of which is hereby incorporated by reference in its entirety.

BACKGROUND OF THE INVENTION

Field of the Invention

The present invention relates to a rail that is fixable to a surface and is adapted to provide a support to which flexible materials may be attached.

Description of Related Art

Netted barriers have a number of uses, not the least of which is as an animal, pet and/or cat enclosure. Netted barriers, including netted enclosures, may be constructed using a number of netting or mesh materials. For example, up to 50×50 mm four-gauge galvanised mesh fixed to a timber frame using washers and Tec screws; 25×25 mm light-weight mesh fixed to a timber frame using washers and Tec screws; galvanised "chicken wire" which may be held in place by battens; or shade cloth or flexible nylon netting held in place by staples, galvanised wire ties or specialised fasteners.

Construction of netted enclosures requires a stable and reliable support to which a flexible net may be attached, and which can bear the weight of the stretching taut of the net. The net should also be able to bear the weight of an enclosed animal trying to climb the net or escape the enclosure.

Commercially installed animal enclosures frequently employ a multi-stranded galvanised or stainless steel wire that encircles the area to be enclosed and is pulled tight by the use of turnbuckles at the end of each section of wire. Turnbuckles must be installed at both internal and external corners around the perimeter of the enclosure to tension the wire. A flexible net is attached to the wire by use of clips that are installed along the edge of the net.

While the above-described netting arrangements are capable of providing safe and secure netted enclosures, installers typically encounter difficulties when installing around corners and in areas where there are edges with complex shapes and profiles.

The present invention seeks to provide an alternative method and system for securing netting to a frame or other stationary support, which method and system simplifies installation of the net.

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure herein.

SUMMARY OF THE INVENTION

An object of the present invention is to provide an improved method and system for securing netting or the like to a frame or other stationary support.

A further object of the present invention is to alleviate at least one disadvantage associated with the related art.

It is an object of the embodiments described herein to overcome or alleviate at least one of the above noted drawbacks of related art systems or to at least provide a useful alternative to related art systems.

The present invention provides a substantially elongate fastening rail comprising a first end and a second end and a plurality of fastening regions having fixing regions located therebetween, wherein the first end, the second end and the fixing regions are each adapted to receive a fixing member.

The present invention also provides the use of a fastening rail according to the present invention in the assembly of a netted barrier or enclosure, wherein the fastening rail is fixed to a stationary support or frame using fixing members that pass through the fixing portions and a net is attached to the fastening region via clips engaging the fastening region of the fastening rail.

The present invention further provides a system comprising a fastening rail according to the present invention for attachment to a stationary support and a flexible material, wherein the fastening rail is fixed to the stationary support and the flexible material is attached to the fastening region of the fastening rail to form a barrier, optionally defining at least a part of an enclosure for enclosing an animal.

Various aspects and preferred forms are disclosed in the specification and/or defined in the appended claims, forming a part of the description of the invention.

In essence, embodiments of the present invention stem from the realization that a rigid rail held slightly above a surface, to which the net is to be affixed, provides an improved substrate to which the net can be readily attached. Other aspects and preferred forms are disclosed in the specification and/or defined in the appended claims, forming a part of the description of the invention.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which:

FIG. 1A is a view from above the rail in an installed condition. FIG. 1B is a side view of the rail. FIG. 1C is an end view of the rail.

DESCRIPTION OF THE INVENTION

Figure 4:
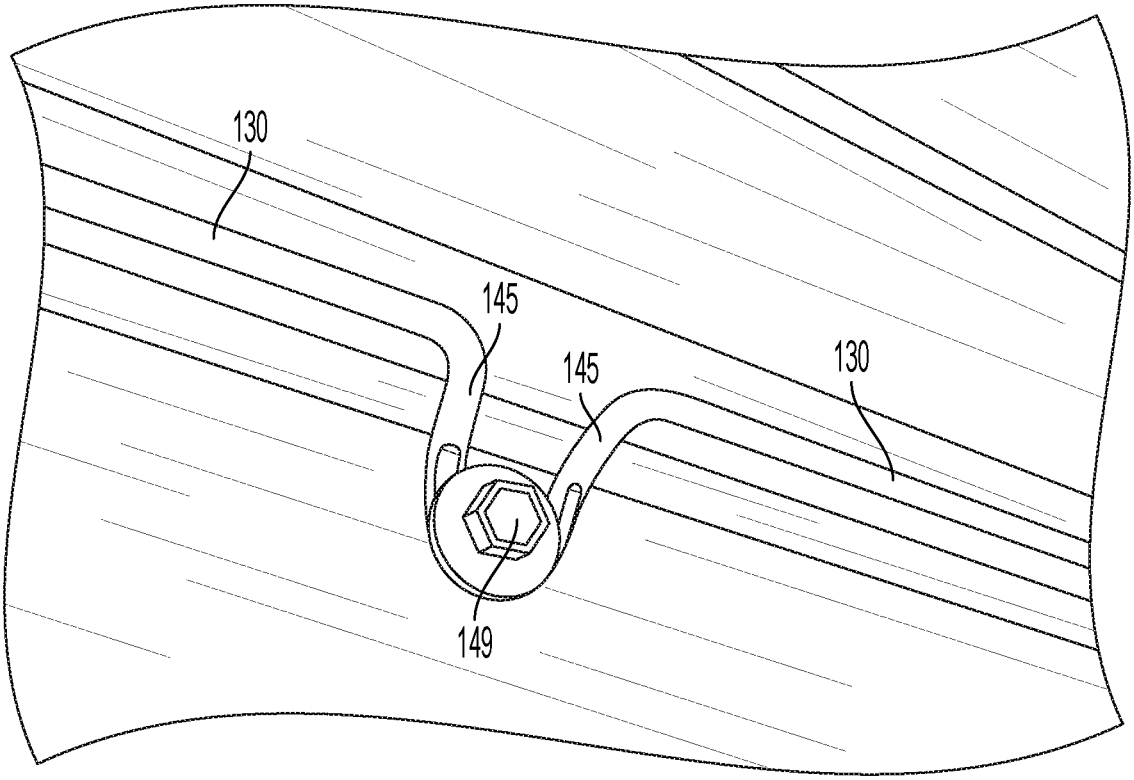
FIG. 4 is a photograph of an embodiment of a rail according to the present invention.

For purposes of description herein, the terms "upper," "lower," "right," "left," "rear," "front," "vertical," "horizontal," "interior," "exterior," and derivatives thereof shall relate to the invention as oriented in FIG. 4. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. Additionally, unless otherwise specified, it is to be understood that discussion of a particular feature or component extending in or along a given direction or the like does not mean that the feature or component follows a straight line or axis in such a direction or that it only extends in such direction or on such a plane without other directional components or deviations, unless otherwise specified.

As used herein, the terms "net", "netting" or "netted" relate to a flexible material designed to allow light and air to pass through but prevent large objects and animals from passing through. Exemplary forms of netting include, but are not limited to: shade cloth; or flexible nylon netting, for example having openings of approximately 20×20 mm, 30×30 mm, 40×40 mm or 50×50 mm.

Exemplary embodiments of a fastening rail according to the present invention are illustrated in FIGS. 1A-C, 2, 3 and 4.

Referring to all the drawings wherein like reference numerals designate like or corresponding parts throughout the several views, the present invention provides a substantially elongate fastening rail 100 comprising a first end 110 and a second end 120 and a plurality of fastening regions 130 and fixing regions 140 located therebetween, wherein the first end 110, the second end 120 and fixing regions 140 are each adapted to receive a fixing member 149, whereby the fixing member 149 releasably secures the fastening rail 100 to a stationary support. Preferably, each pair of fastening regions 130 is separated by a fixing region 140. Most preferably, the first end 110, the plurality of fastening regions 130 and fixing regions 140, and the second end 120 are disposed linearly.

The fixing regions 140 may be of any convenient shape or configuration that is suitable for interaction with the fixing member 149 such that the fastening rail 100 may be secured to a surface of a structure. In embodiments of the present invention, the fixing regions 140 are substantially U-shaped. Preferably, each of the fixing regions 140 comprises two linking portions 145 and a fixing portion 147 located between the linking portions 145. Preferably, the fixing portion 147 is adapted to receive a fixing member 149, such as a screw or other similar fastener, whereby the fastening rail 100 may be secured to a stationary support.

As used herein, the term "U-shaped" is intended to describe the general shape of the fixing region 140 and is intended to encompass similar shapes such as "V", wherein the bottom of the "U" or the valley of the "V" defines the fixing portion 147. During installation of the fastening rail 100, a fixing member 149 is passed through the fixing portion 147, whereby a flange on the fixing member 149 and/or a washer associated with the fixing member 149 covers at least part of the fixing portion to secure the fastening rail 100 to a stationary support.

The first and second ends 110,120 are of substantially similar arrangement to the fixing regions 140 except that each of the first and second ends 110,120 joins only one fastening region 130.

The linking portions 145 are preferably continuous with the fixing portion 147. Preferably, each linking portion 145 is also continuous with a fastening region 130 and each fastening region 130 is bounded by linking portions 145, or a linking portion 145 and a first or second end 110, 120.

Figure 1A:
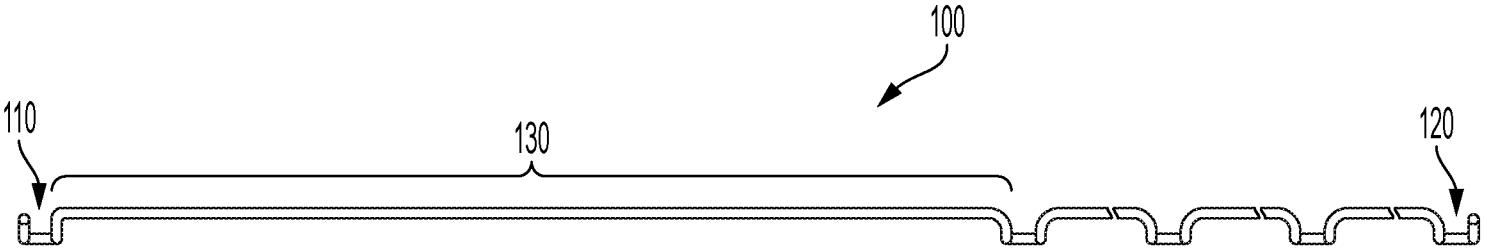
FIGS. 1A-C are a series of sketches illustrating an embodiment of a rail according to the present invention.
Figure 1B:
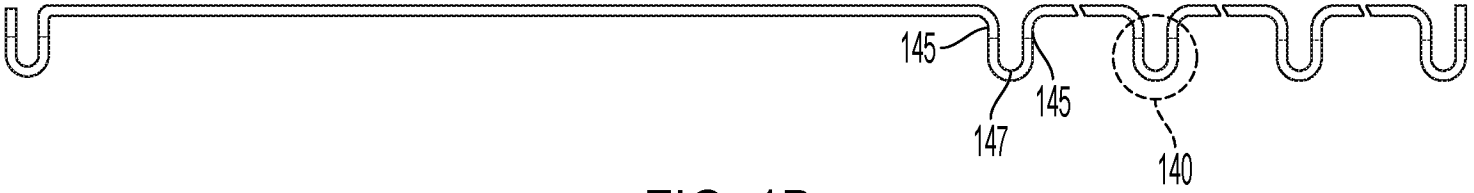
Figure 1C:
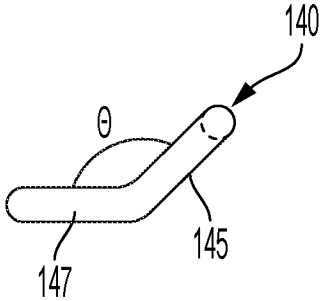
Figure 2:
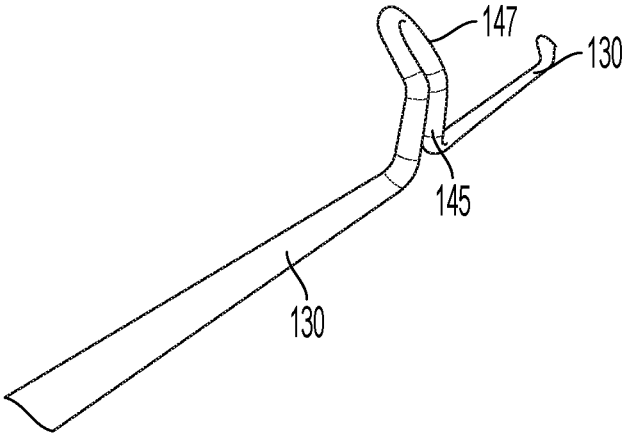
FIG. 2 is a photograph of an embodiment of a rail according to the present invention.
Figure 3:
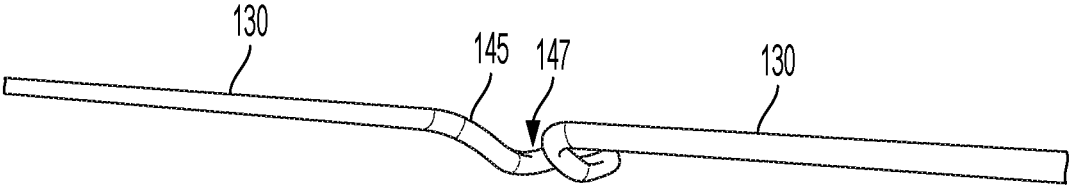
FIG. 3 is a photograph of an embodiment of a rail according to the present invention.

In some embodiments of the present invention, the linking portions 145 and the fixing portion 147 are co-planar. Alternatively, and in order to facilitate use of the fastening rail 100, the linking portions 145 and the fixing portion 147 are not co-planar, whereby the fastening regions 130 and linking portions 145 are in a first plane and the fixing portions 147 are in a second plane. Preferably, as shown in FIG. 1C, there is an obtuse angle between the first plane and the second plane. More preferably, the obtuse angle (e) is between 90 and 170 degrees; or between 90 and 150 degrees; or between 110 and 150 degrees; or approximately 135 degrees.

The angle between the fixing portion and the linking portion means that when the fixing portion is secured to a surface and lies flat thereagainst, the linking portion is angled away from the surface, thereby positioning the fastening region away from the surface and facilitating attachment of the net thereto.

In preferred embodiments, the fastening region is substantially linear. In further preferred embodiments, each fastening region is adapted to be engaged by a clip, wherein the clip is also attached to a net.

In preferred embodiments, the fastening rail is comprised of a substantially rigid metal, preferably steel, optionally stainless steel. Preferably, the rail is comprised of a rod with a substantially circular cross-section of between 3 mm and 10 mm in diameter. Most preferably, the rod has a diameter of approximately 3 mm to 6 mm. In certain embodiments, the rod has a diameter of 3.15 mm.

In certain embodiments of the invention, the fastening region may be of a length that will not substantially bend under the forces applied by the taut netting material attached thereto. For example, and without limitation, in embodiments where the fastening rail is constructed from 3.15 mm diameter stainless steel, the fastening region may be in the order of 300 to 400 mm long, optionally, between 330 and 370 mm. In yet further embodiments, the fastening regions may be approximately 340, 350 or 360 mm long.

During installation of the fastening rail, it is envisaged that the fastening region may be bent in order to pass around a corner. It is this aspect of the present invention that provides one of the advantages of the invention over previous fastening systems. Previous systems required fixtures at corners in order to fix and tension the wire to which the net would be attached. Using the present system, there are no mounting components under tension, and the fastening rail is held above, or away from, the surface to which the fastening rail is secured. Bending the fastening rail to match a corner of the surface allows the fastening rail to pass around the corner, maintaining its displacement from the surface and facilitating attachment of the net.

The present invention also provides a method of using a fastening rail according to present invention in the assembly of a netted barrier or enclosure, wherein the fastening rail is fixed to a stationary support such as a wall using fixing member that pass through the fixing portions and a net is attached to the fastening region via clips engaging the fastening region of the fastening rail. In preferred embodiments, the netted enclosure is a pet enclosure.

While the invention is described herein in relation to pet enclosures, the invention is not so limited. For example, other animal enclosures such as bird enclosures or aviaries could be constructed using the rails of the present invention. Netted barriers constructed using the system of the present invention also find application in excluding animals, including birds, from areas, such as building roofs and undercover carparks. Additionally, any form of netted enclosure or wall could employ the fastening rail of the present invention as would be readily understood by the skilled reader. The rails of the present invention may find application in any number of situations where a flexible material must be held tight or stretched. This could include, for example, situations in which shade cloth must be held tight or stretched.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

When a Markush group or other grouping is used herein, all individual members of the group and all combinations and sub-combinations possible of the group members are intended to be individually included in the disclosure. Every combination of components described or exemplified herein can be used to practice the invention, unless otherwise stated.

One of ordinary skill in the art will appreciate that materials and methods, other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by examples, preferred embodiments and optional features, modification and variation of the concepts herein disclosed may be resorted to by those skilled in the art, and that such modifications and variations are considered to be within the scope of this invention as defined by the appended claims.

Table of parts

| No. | Part |
|---|---|
| 100 | Fastening rail |
| 110 | First end |
| 120 | Second end |
| 130 | Fastening region |
| 140 | Fixing region |
| 145 | Linking portion |
| 147 | Fixing portion |
| 149 | Fixing member |

I claim:

1. A substantially elongate fastening rail comprising a metal rod having a first end and a second end and a plurality of fastening regions having fixing regions located therebetween, wherein;

a) the first end, the second end and the fixing regions are each adapted to receive a fixing member;

b) the first end, the plurality of fastening regions and fixing regions, and the second end are disposed linearly;

c) the fixing regions are substantially U-shaped; and d) each of the substantially U-shaped fixing regions comprise two linking portions and a fixing portion located between the linking portions; and wherein there is an obtuse angle between the linking portions and the fixing portion.

2. The fastening rail of claim 1, wherein the obtuse angle is between 90 and 150 degrees.

3. The fastening rail of claim 2, wherein the obtuse angle is approximately 135 degrees.

4. The fastening rail of claim 1, wherein each fastening region is substantially linear.

5. The fastening rail of claim 1, wherein the fastening rail is a steel rod with a substantially circular cross-section of 3 mm to 10 mm in diameter.

6. The fastening rail of claim 5, wherein the rod has a substantially circular cross-section of 3.15 mm in diameter.

7. The fastening rail of claim 1, wherein the obtuse angle is 110 to 150 degrees.

* * * * *